United States Patent [19]

Arens

[11] Patent Number: 4,515,537

[45] Date of Patent: May 7, 1985

[54] DOSING PUMP

[75] Inventor: Hans Arens, Wertingen, Fed. Rep. of Germany

[73] Assignee: Grunbeck Wasserauebereitung GmbH, Fed. Rep. of Germany

[21] Appl. No.: 412,394

[22] Filed: Aug. 30, 1982

[30] Foreign Application Priority Data

Sep. 3, 1981 [DE] Fed. Rep. of Germany ..... 3134940

[51] Int. Cl.[3] ..... F04B 7/04; F04B 23/04

[52] U.S. Cl. ..... 417/489; 417/503; 417/521; 222/318

[58] Field of Search ..... 417/503, 439, 489, 521; 92/83, 86.5; 222/318, 105; 604/123

[56] References Cited

U.S. PATENT DOCUMENTS

| | | | |
|---|---|---|---|
| 862,867 | 8/1907 | Eggleston | 417/390 |
| 3,765,802 | 10/1973 | Leitermann et al. | 417/503 X |
| 3,945,772 | 3/1976 | Van de Moortele | 417/503 X |
| 4,035,109 | 7/1977 | Drath et al. | 417/489 X |
| 4,139,122 | 2/1979 | Bauer | 417/489 X |
| 4,336,000 | 6/1982 | Jorgensen et al. | 417/503 X |
| 4,336,800 | 6/1982 | Giovanni | 604/123 |
| 4,375,864 | 3/1983 | Savage | 222/105 X |

FOREIGN PATENT DOCUMENTS

| | | | |
|---|---|---|---|
| 2651614 | 5/1978 | Fed. Rep. of Germany | 417/521 |

*Primary Examiner*—William L. Freeh
*Assistant Examiner*—Paul F. Neils
*Attorney, Agent, or Firm*—Donald Brown

[57] ABSTRACT

A dosing pump (1) is produced, with which a precise dosing is possible as a function of the time or of a flow rate. The dosing pump (1) operates with a preliminary transport obtained by means of a diaphragm (11). The stroke volume of the diaphragm (11) is greater than the volume of the pipe element present between a preliminary transport chamber (9) and a dosed medium tank (16). It is thereby made possible to omit a return pipe and a suction valve and a pressure valve.

9 Claims, 1 Drawing Figure

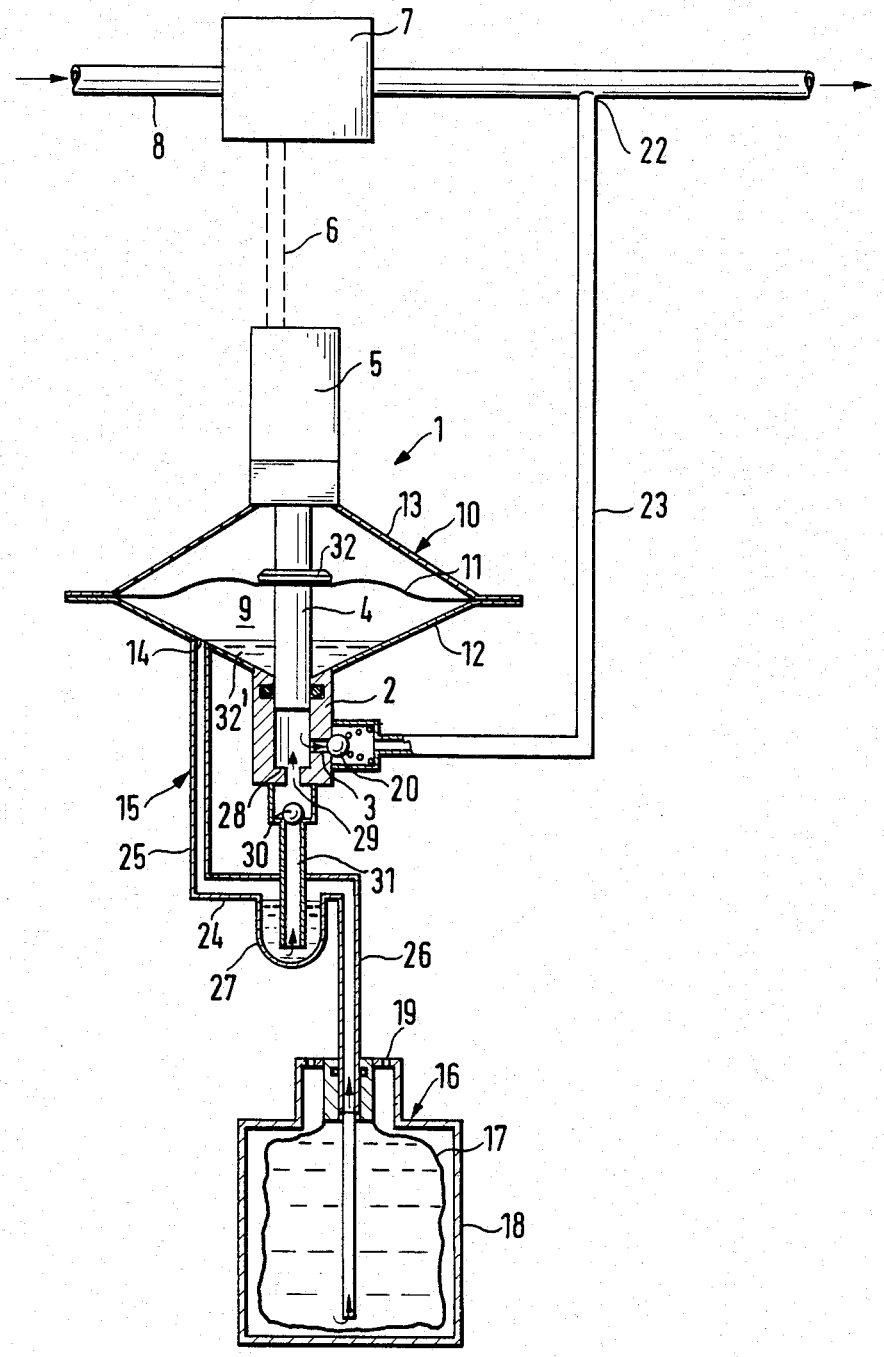
7
8
22
6
5
1
13
10
23
32
11
9
4
14
12
32'
2
20
15
28
3
29
25
30
31
24
26
27
19
16
17
18

DOSING PUMP

FIELD OF THE INVENTION

The invention relates to a dosing pump.

BACKGROUND OF THE INVENTION

In a known dosing pump with dosing piston-cylinder device and preliminary transport diaphragm, the preliminary transport chamber is connected to a dosed medium tank via a suction valve with a suction pipe and via a pressure valve with a return pipe. The preliminary transport occurs via the suction pipe and the suction valve to the preliminary transport chamber. The dosing piston takes the required quantity of dosed medium from the preliminary transport chamber. The surplus quantity of the dosed medium is transported back via the pressure valve and the return pipe into the dosed medium tank. The apparatus is relatively complicated because of the need to provide suction and pressure valves and a return pipe. In a known dosing pump, the pump cylinder is connectable via a pressure valve to a dosing station. When the piston emerges from the pump cylinder virtually an evacuation occurs, which leads to a gassing out of the dosed medium. In the case of certain dosed media, e.g. silicates, caustic soda solutions etc., this leads to crystallising out in the pump cylinder and hence to destruction of the dosing pump. With other dosed media such an evacuation leads to a polymerisation, and thus likewise to the destruction of the piston-cylinder device. Moreover, the provision of suction pipe and pressure pipe between preliminary transport chamber and dosed medium tank renders the bacteria-proof and gas-tight connection between dosing pump and dosed medium tank difficult.

OBJECT OF THE INVENTION

It is an object of the invention to provide an improved dosing pump. A further object of the invention is the providing of a dosing pump by avoiding other prior art. According to a further object of the invention the dosing pump should particularly exhibit a simple structure and nevertheless possess high dosing precision. According to a further object of the invention, the expansion in the pump cylinder when the piston emerges should be avoided.

SUMMARY OF THE INVENTION

The invention provides a dosing pump with a pump cylinder means connected on the inlet side to a preliminary transport chamber and on the outlet side to a dosing station and with a dosing piston means cooperating therewith and with a diaphragm means, wherein the preliminary transport chamber is located above the pump cylinder means and exhibits a pipe element connectable to a dosed medium tank inlet, the stroke volume of the diaphragm means being greater than the volume of the pipe element connectable to the inlet of the dosed medium tank. It is thereby possible to omit a suction valve and a pressure valve at the preliminary transport chamber, because during the movement of the diaphragm from bottom dead centre upwards, not only is the air in the suction system exhausted, but sufficient dosed medium is also transported out of the storage tank into the preliminary transport chamber.

The opening of the preliminary transport chamber is preferably located at a higher level than the inlet of the pump cylinder. In this way the dosed medium always surrounds the pump piston, so that the formation of a coating on the pump piston is prevented.

According to a preferred embodiment of the invention the pipe element is connected to a pump sump, which is connected via a pipe with the pump cylinder. During suction in the dosing pump cylinder, therefore, dosed medium is sucked out of the pump sump, whereby the expansion or evacuation and the resulting gassing out or crystallising out or polymerisation is prevented.

Further features and convenient aspects of the invention will emerge from the description of an exemplary embodiment with reference to the FIGURE.

The FIGURE shows a schematic view of a dosing pump connected to a water supply means with dosed medium tank, shown partly sectioned.

The dosing pump 1 comprises a pump cylinder 2 with an inlet located at the top, considered in the vertical direction, and with an outlet 3 located near its lower end. Provided above the pump cylinder 2 is a dosing piston 4, which moves in reciprocation relatively to the pump cylinder by means of a schematically illustrated stroke drive means 5, and is therefore made to dip into and emerge from the cylinder. The stroke drive means 5 is connected by means of a control wire 6 to an impulse transmitter 7, which delivers control impulses to the stroke drive means as a function of the quantity of liquid flowing through a pipe 8.

The pump cylinder 2 is connected at its top side to a preliminary transport chamber 9, which is formed by a housing 10. The walls of the housing 10 may be constructed in the form of diaphragm clamps 12, 13 laterally clamping a diaphragm 11. The lower part of the housing 10 is connected fluidtightly to the pump cylinder wall. At an interval from the pump cylinder wall there is provided an opening 14, which is adjoined by a fluid connection line formed by a tubular pipe 15. Considered in the vertical direction, the opening 14 is located at a higher level than the inlet side of the pump cylinder 2.

The pipe 15 leads to a dosed medium tank 16, which preferably exhibits a flexible bag 17 containing the dosed medium and carried by a supporting tank 18. The supporting tank exhibits ventilation orifices 19. The pipe 15 is connected fluidtightly to the inside of the flexible bag 17. In this way a bacteria-proof connection is made between pipe 15 and dosed medium tank, because no ventilation of the dosed medium is necessary. In the case of non-gassing dosed media particularly, it is also possible to use a conventional dosed medium tank, in which air flows in correspondingly to the quantity of dosed medium sucked out. To ensure that this air flows into the tank sterile, a bacterial filter may be provided in the ventilation orifice.

A pressure valve 20 is connected directly to the outlet 3, being constructed as a spring-pretensioned ball valve in the exemplary embodiment illustrated. The pressure valve is adjoined by a connecting pipe 23 leading to a dosing station 22. The pressure valve 20 is provided as close as possible to the pump cylinder and preferably directly at the outlet of the latter.

The pipe 15 exhibits a region 25 of steep gradient connected to the opening 14, and a second region 26 of steep gradient connected to the dosing tank, also an intermediate region 24 with little or no gradient. A pump sump 27, the top side of which is open towards the interior of the pipe region 24, is provided on the underside of the region 24.

The pump cylinder 2 exhibits at its end 28 located underneath in the vertical direction an orifice 29 which leads via a suction valve 30 directly adjoining the latter and a suction pipe 31 into the interior of the pump sump 27. The suction pipe extends virtually to the bottom of the pump sump.

As shown in the FIGURE, the diaphragm 11 is connected to the dosing piston, e.g. by a fixing washer 32, so that the diaphragm is moved by the rise and fall of the dosing piston. The size of the preliminary transport chamber and the stroke movement by the diaphragm 11 are dimensioned so that the stroke volume of the diaphragm is greater than the volume of the pipe 15. During the movement of the diaphragm 11 from the bottom dead centre upwards, the air in the suction system is exhausted in the first stroke, and the dosed medium is transported out of the flexible bag 17 into the preliminary transport chamber 9. The dosing piston 4 is emerged from the pump cylinder 2 by the lifting of the diaphragm 11, so that a part of the dosed medium transported totally fills the pump cylinder 2 and a surplus 32' remains in the preliminary transport chamber 9. The dosing now occurs during the downward movement of pump piston 4 and diaphragm 11, and the major part of the dosed medium present in the preliminary transport chamber is transported back into the dosed medium tank 16. A part 32' of the previously transported quantity of the dosed medium remains above the dosing piston 4, because the opening 14, considered in the vertical direction, has a higher level than the top inlet of the pump cylinder 2. The height difference between the opening 14 and the inlet of the pump cylinder is chosen so that a desired section of the pump cylinder envelope always remains in the transported dosed quantity, in order to prevent the formation of a coating on the dosing piston.

During the suction and the return transport of dosed liquid, the sump 27 is permanently filled with dosed medium. During the rise of the dosing piston 4 dosed medium is sucked out of the pump sump 27 via the suction pipe 31 and the suction valve 30 into the pump cylinder 2, so that any evacuation in this chamber leading to crystallising out or polymerisation is prevented. The size of the pump sump 27 is chosen so that sufficient liquid always remains during suction, and prevents the possibility of any air which may be pulsating in the pipe 15 during operation or service penetrating into the suction valve 30 of the dosing pump 1.

Although the invention has been described with reference to specific example embodiments, it is to be understood, that it is intended to cover all modifications and equivalents within the scope of the appended claims.

What I claim is:

1. A dosing pump comprising pump cylinder means having a first inlet, a second inlet, and an outlet, a suction valve means and a discharge valve means being provided at the second inlet and the outlet, respectively, dosing piston means cooperating with the pump cylinder means, diaphragm means connected with the dosing piston means and disposed within a diaphragm chamber and a fluid connection line connecting the diaphragm chamber and an opening thereof with a dosed medium tank, wherein the diaphragm chamber is disposed at a level above the pump cylinder means and connected with the pump cylinder means via a connection forming the first inlet of the pump cylinder means, the dosing piston means extending through this connection and allowing fluid to enter the pump cylinder means from the diaphragm chamber when the dosing piston means emerges from the pump cylinder means, and wherein the second inlet is connected with a suction pipe and the fluid connection line is connected with a pump sump, the suction pipe extending into the pump sump.

2. The dosing pump of claim 1, wherein the opening of the diaphragm chamber is provided at the level above the first inlet of the pump cylinder means.

3. The dosing pump according to claim 1, wherein the dosed medium tank connectable to the fluid connection line exhibits a flexible bag means containing the dosed medium, its outside communicating with the ambient air.

4. A dosing pump comprising pump cylinder means having a first inlet, a second inlet and an outlet, a suction valve means and a discharge valve means being provided at the second inlet and the outlet, respectively, dosing piston means cooperating with the pump cylinder means, diaphragm means connected with the dosing piston means and disposed within a diaphragm chamber and a fluid connection line connecting the diaphragm chamber at an opening thereof with a dosed medium tank, the diaphragm means having a stroke volume which is greater than the volume of the fluid connection line, wherein the diaphragm chamber is disposed at a level above the pump cylinder means and connected with the pump cylinder means via a connection forming the first inlet of the pump cylinder means, the dosing piston means extending through this connection, and allowing dosing medium to enter the pump cylinder through this connection when the dosing piston means emerges from the pump cylinder, and wherein the second inlet of the pump cylinder means is connected with a suction pipe and the fluid connection line is connected with a pump sump and wherein the suction pipe extends into the pump sump.

5. The dosing pump according to claim 4, wherein the suction valve means is provided between the pump cylinder means and the pump sump means.

6. The dosing pump according to claim 4, wherein the dosed medium tank connectable to the fluid connection line exhibits a flexible bag means containing the dosed medium, its outside communicating with the ambient air.

7. A dosing pump comprising pump cylinder means having a first inlet, a second inlet, and an outlet, a suction valve means and a discharge valve means being provided at the second inlet and the outlet, respectively, dosing piston means cooperating with the pump cylinder means, diaphragm means connected with the dosing piston means and disposed within a diaphragm chamber and a fluid connection line connecting the diaphragm chamber at an opening thereof with a dosed medium tank, wherein the diaphragm chamber is disposed at a level above the pump cylinder means and connected with the pump cylinder means via a connection forming the first inlet of the pump cylinder means, the dosing piston means extending through this connection, and wherein the diaphragm chamber is operating as a preliminary transport chamber containing dosing medium sucked from the dosed medium tank through the fluid connection line and supplying dosing medium to the pump cylinder means through the first inlet thereof when the dosing piston means emerges from the pump cylinder means, and wherein the second inlet of the pump cylinder means is connected with a suction pipe and the fluid connection line is connected with a pump sump and wherein the suction pipe extends into the pump sump.

8. The dosing pump according to claim 7, wherein the suction valve means is provided between the pump cylinder means and the pump sump means.

9. The dosing pump according to claim 7, wherein the dosed medium tank connectable to the fluid connection line exhibits a flexible bag means containing the dosed medium, its outside communicating with the ambient air.

* * * * *